US006884178B1

(12) United States Patent
Frost

(10) Patent No.: US 6,884,178 B1
(45) Date of Patent: Apr. 26, 2005

(54) KIT AND METHOD FOR PLAYING A GOLF-LIKE GAME

(76) Inventor: Ken C. Frost, 9229 9th Ave. NW., Seattle, WA (US) 98117

( * ) Notice: Subject to any disclaimer, the term of this patent is extended or adjusted under 35 U.S.C. 154(b) by 0 days.

(21) Appl. No.: 10/641,762

(22) Filed: Aug. 15, 2003

(51) Int. Cl.[7] ..... A63B 69/36
(52) U.S. Cl. ..... 473/150; 473/196; 473/173
(58) Field of Search ..... 473/150, 153, 473/165, 170, 173, 190–196, 157–164, 172, 180, 181, 185, 409

(56) References Cited

U.S. PATENT DOCUMENTS

| | | | | | |
|---|---|---|---|---|---|
| 2,235,358 | A | * | 3/1941 | Connell | 473/196 |
| 3,019,023 | A | * | 1/1962 | Westling | 473/180 |
| 3,086,779 | A | * | 4/1963 | Taylor | 473/180 |
| 3,467,388 | A | * | 9/1969 | Weiler | 473/196 |
| 3,490,769 | A | * | 1/1970 | Torbett | 473/196 |
| 3,526,405 | A | * | 9/1970 | Morris | 473/191 |
| 4,171,134 | A | * | 10/1979 | Reck | 473/196 |
| 5,163,684 | A | * | 11/1992 | Seidler | 473/196 |
| 5,383,665 | A | * | 1/1995 | Schultz et al. | 473/159 |
| 5,401,027 | A | * | 3/1995 | Surbeck | 473/173 |
| 5,441,267 | A | * | 8/1995 | Alder | 473/173 |
| 5,830,076 | A | * | 11/1998 | Borys | 473/173 |
| 6,083,114 | A | * | 7/2000 | Bailey | 473/196 |
| 6,241,621 | B1 | * | 6/2001 | Maher | 473/185 |

* cited by examiner

*Primary Examiner*—Mark S. Graham

(57) ABSTRACT

Kits and methods for playing a golf-like game provide golfers with a fun and challenging alternative to conventional golf. A kit comprising three T-joints, three tubes, three poles, three flags, a mat of artificial turf, a marker, and six plastic golf balls is disclosed. The opposing ends of the tubes are inserted into the opposing ends of the T-joints to form rings, and the flags are attached by the poles to the middle of the T-joints. Each of the flags has a different color, with one flag being red, one being yellow, and one being blue. Various methods of play using the kit and standard commercially available golf clubs are disclosed, including horseshoes, traditional golf, and "Golf 500."

5 Claims, 3 Drawing Sheets

KIT AND METHOD FOR PLAYING A GOLF-LIKE GAME

BACKGROUND OF THE INVENTION

1. Field of the Invention

The present invention relates to a kit and method for playing a golf-like game for use in connection with recreation. The kit and method for playing a golf-like game has particular utility in connection with providing golfers with a fun and challenging alternative to conventional golf.

2. Description of the Prior Art Kits and methods for playing a golf-like game are desirable for providing golfers with a fun and challenging alternative to conventional golf. Kits and methods for playing a golf-like game allow an individual to create a simulated golf course on an area of property. They also allow an individual to play other games such as a version of horseshoes and target practice while using golf equipment. Kits and methods for playing a golf-like game allow users to improve their golfing skills while participating in a fun sport activity. The kit and method for playing golf-like game is also adaptable for indoor use.

The use of golf games is known in the prior art. For example, U.S. Pat. No. 3,784,207 to Gentiluomo discloses a golf game. However, the Gentiluomo '207 patent does not function without electric power, and has further drawbacks of requiring ball confining means.

U.S. Pat. No. 5,575,483 to Dineen et al. discloses a golf toss game that is a recreational game. However, the Dineen et al. '483 patent does not have golf balls, and additionally does not utilize golf clubs.

Similarly, U.S. Pat. No. 5,163,684 to Siedler discloses a chip shot practice ring that receives chipped or pitched golf balls. However, the Siedler '684 patent does not have a mat, and cannot be fully utilized without a battery.

In addition, U.S. Pat. No. 5,016,891 to Nelson discloses a projectile-target game apparatus that is a game. However, the Nelson '891 patent does not have golf balls, and also does not utilize golf clubs.

Furthermore, U.S. Pat. No. 4,928,973 to Perry et al. discloses a method and course for playing a golf-like game that is a new course concept and method of playing golf. However, the Perry et al. '973 patent does not have a mat, and has further drawbacks of requiring 12 acres of land.

Lastly, U.S. Pat. No. Des. 174,253 to Evans discloses a golf putting practice cup that is used to practice putting. However, the Evans '253 patent does not have a mat, and has the additional deficiency of lacking golf balls.

While the above-described devices fulfill their respective, particular objectives and requirements, the aforementioned patents do not describe a kit and method for playing a golf-like game that allows providing golfers with a fun and challenging alternative to conventional golf.

The Dineen et al. '483 patent, the Nelson '891 patent, and the Evans '253 patent make no provision for golf balls. The Dineen et al. '483 patent and the Nelson '891 do not utilize golf clubs. The Gentiluomo '207 patent requires electric power, and has further drawbacks of requiring ball confining means. The Siedler '684 patent, the Perry et al. '973 patent, and the Evans '253 patent lack a mat. The Siedler '684 patent cannot be fully utilized without a battery. The Perry et al. '973 patent requires 12 acres of land.

Therefore, a need exists for a new and improved kit and method for playing a golf-like game that can be used for providing golfers with a fun and challenging alternative to conventional golf. In this regard, the present invention substantially fulfills this need. In this respect, the kit and method for playing a golf-like game according to the present invention substantially departs from the conventional concepts and designs of the prior art, and in doing so provides an apparatus primarily developed for the purpose of providing golfers with a fun and challenging alternative to conventional golf.

SUMMARY OF THE INVENTION

In view of the foregoing disadvantages inherent in the known types of golf games now present in the prior art, the present invention provides an improved kit and method for playing a golf-like game, and overcomes the above-mentioned disadvantages and drawbacks of the prior art. As such, the general purpose of the present invention, which will be described subsequently in greater detail, is to provide a new and improved kit and method for playing a golf-like game which has all the advantages of the prior art mentioned heretofore and many novel features that result in a kit and method for playing a golf-like game which is not anticipated, rendered obvious, suggested, or even implied by the prior art, either alone or in any combination thereof.

To attain this, the present invention essentially comprises a kit consisting of a tube with opposing ends, a T-joint with opposing ends and a middle, a pole with opposing ends, a flag, a golf ball, a mat, and a marker.

The present invention also comprises two primary methods of play. The first method comprises the steps of placing one or more rings in an area; placing one or more mats in an area; identifying one or more players to play the game; writing each player's name on at least one golf ball using the marker, and standing on or adjacent to the mat, each player taking turns placing his or her golf ball on the mat and striking it with a golf club towards one of the rings. The second method comprises the steps of placing two rings in an area; identifying one or more players to play the game; writing each player's name on at least one golf ball using the marker; assigning one of the rings to each player; standing adjacent to their assigned ring, each player taking turns placing his or her golf ball adjacent to their assigned ring and striking it with a golf club towards the opposing player's ring; determining the score of each player by adding three points if the player's golf ball has landed in the opposing player's ring, two points if the player's golf ball is abutting the outside of the opposing player's ring, one point if the player's golf ball is within a club length of the opposing player's ring, and no points if the player's golf ball is beyond a club length of the opposing players ring; and repeating the previous two steps until a player achieves a total score of 21 or more points, thereby establishing a winner.

There has thus been outlined, rather broadly, the more important features of the invention in order that the detailed description thereof that follows may be better understood and in order that the present contribution to the art may be better appreciated.

The invention may also include the opposing ends of the tube being connected to the opposing ends of the T-joint to form a ring. One end of the pole may be connected to the middle of the T-joint. The opposing end of the pole may be connected to the flag. The golf ball may be a plastic golf ball or a regulation golf ball. The mat may be made of artificial turf. The tube, the T-joint, and the pole may be selected from the group consisting of plastic, steel, aluminum, titanium, wood, and carbon fiber composite. The flag may be made of vinyl. The flag may be red, yellow, or blue in color. The first method of play may further comprise the steps of moving to the location where their golf ball landed after the prior stroke and standing at the location, each player taking turns striking their golf ball with a golf club towards one of the rings; completing the objective by landing the golf ball within the ring; and determining score of each player by calculating the number of strokes to reach the ring. The first method of play may also comprise a step of repeating the preceding four steps until all rings have been reached. The first method of play may further comprise a step after all the rings have been reached, and a total score is determined for each player, of determining the lowest total score and declaring a winner. The first method of play may include there being three rings with three flags, with one flag being red in color, one flag being yellow in color, and one flag being blue in color, further comprising a step following the second step of arranging the rings so that the ring with the red flag is closest to the mat, the ring with the blue flag is furthest from the mat, and the ring with the yellow flag is an intermediate distance from the mat. The first method of play may further comprise the steps of determining score of each player by adding 50 points if the player's golf ball has landed in the ring with the red flag, 100 points if the player's golf ball has landed in the ring with the yellow flag, 200 points if the player's golf ball has landed in the ring with the blue flag, and zero points if the player's golf ball has not landed within a ring; and repeating the previous two steps until a player achieves a total score of 500 or more points, thereby establishing a winner. The second method of play may include the first step further comprising the rings being placed about 25 ft. apart. The second method of play may include the players playing in teams of two. The tube may be about 48 in. long. The pole may be about 18 in. long. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved kit and method for playing a golf-like game that has all of the advantages of the prior art golf games and none of the disadvantages.

It is another object of the present invention to provide a new and improved kit and method for playing a golf-like game that may be easily and efficiently manufactured and marketed.

An even further object of the present invention is to provide a new and improved kit and method for playing a golf-like game that has a low cost of manufacture with regard to both materials and labor, and which accordingly is then susceptible of low prices of sale to the consuming public, thereby making such kit and method for playing a golf-like game economically available to the buying public.

Still another object of the present invention is to provide a new kit and method for playing a golf-like game that provides in the apparatuses and methods of the prior art some of the advantages thereof, while simultaneously overcoming some of the disadvantages normally associated therewith.

Even still another object of the present invention is to provide a kit and method for playing a golf-like game for providing golfers with a fun and challenging alternative to conventional golf. This allows the user to simulate the game of golf on an area of property.

Still yet another object of the present invention is to provide a kit and method for playing a golf-like game for providing golfers with a fun and challenging alternative to conventional golf. This makes it possible to play the golf-like game indoors.

An additional object of the present invention is to provide a kit and method for playing a golf-like game for providing golfers with a fun and challenging alternative to conventional golf. This permits the user to improve his or her golfing skills.

A further object of the present invention is to provide a kit and method for playing a golf-like game for providing golfers with a fun and challenging alternative to conventional golf. This enables multiple persons to participate easily. Lastly, it is an object of the present invention to provide a new and improved kit and method for playing a golf-like game for providing golfers with a fun and challenging alternative to conventional golf.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
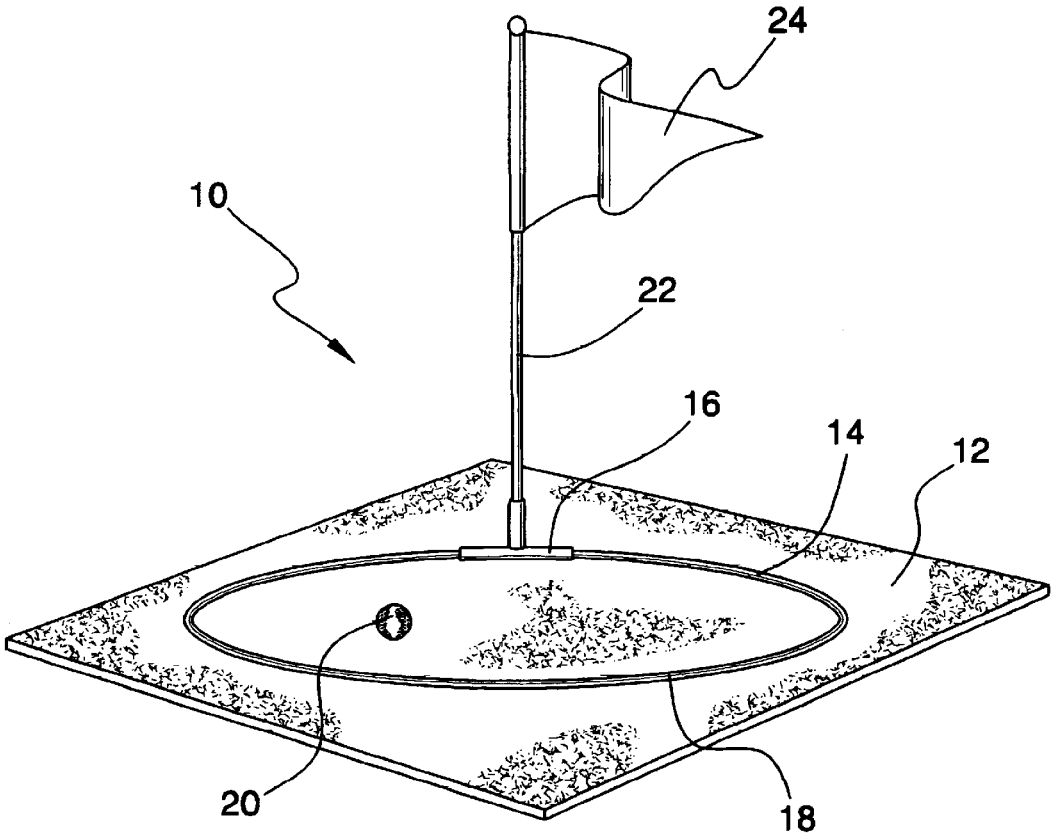
FIG. 1 is a top perspective view of the current embodiment of the kit for playing a golf-like game constructed in accordance with the principles of the present invention.
Figure 2:
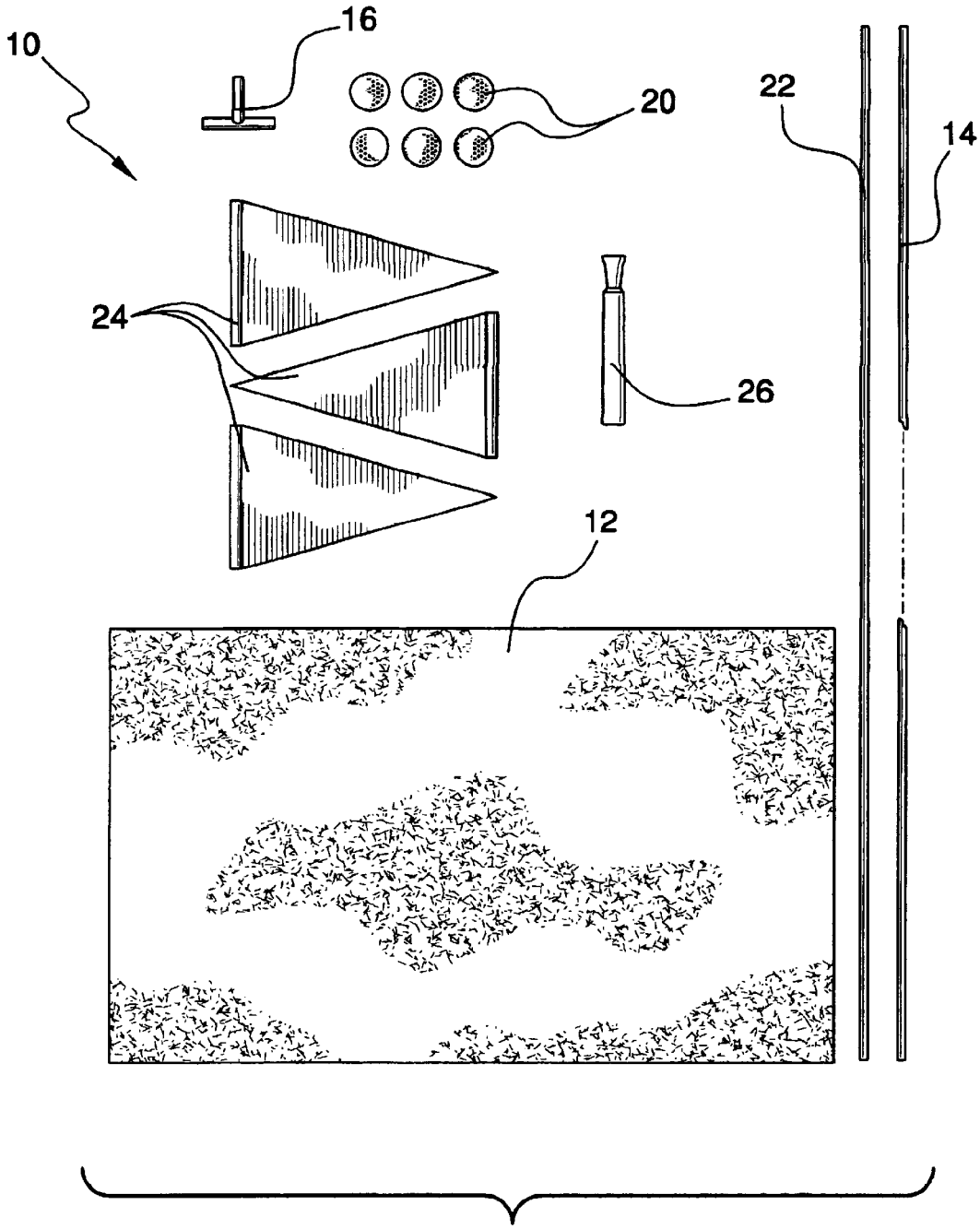
FIG. 2 is a side view of the kit for playing a golf-like game of the present invention.
Figure 3:
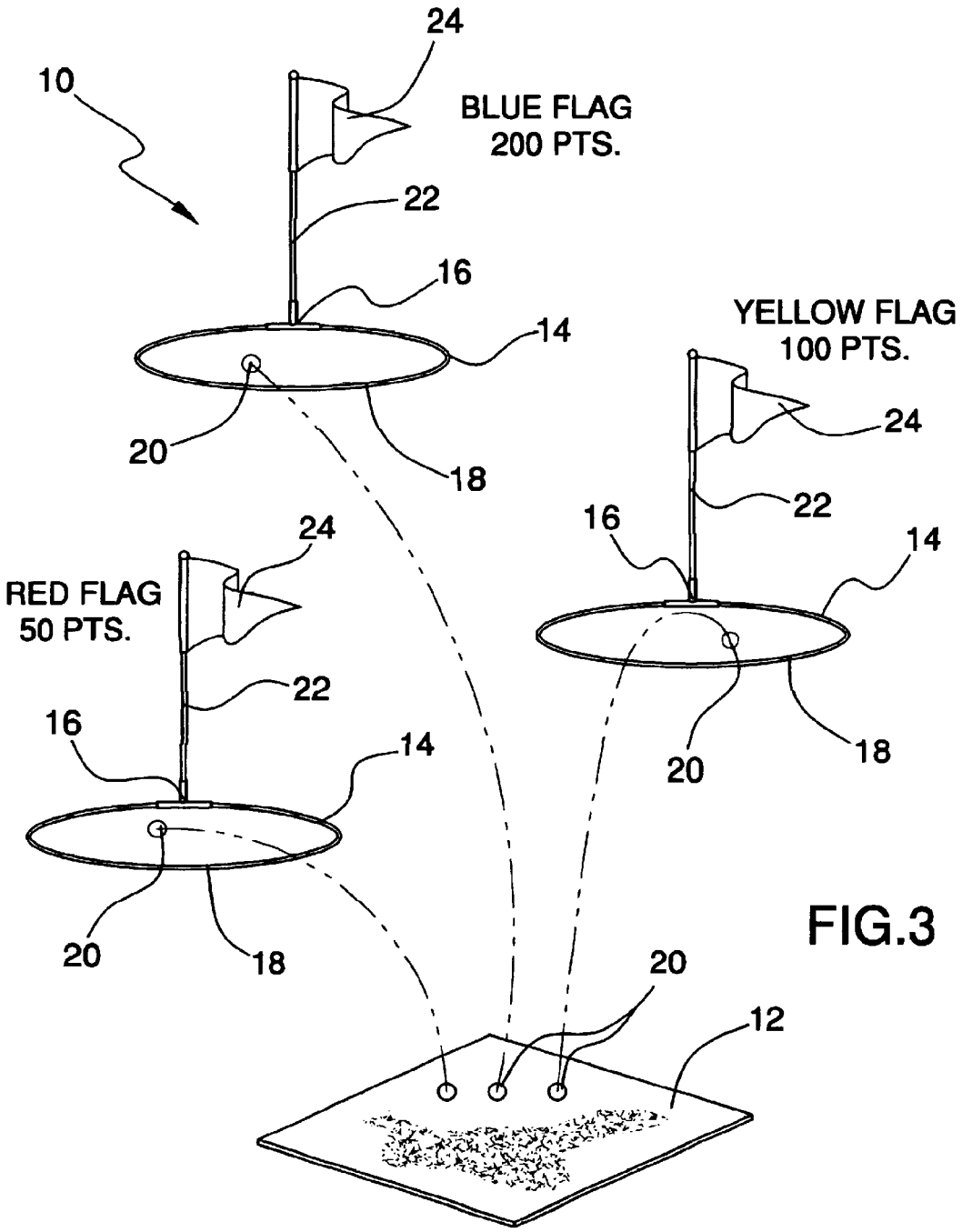
FIG. 3 is a top perspective view of the kit and method for playing a golf-like game of the present invention.

Referring now to the drawings, and particularly to FIGS. 1–3, a current embodiment of the kit for playing a golf-like game of the present invention is shown and generally designated by the reference numeral 10.

In order to utilize the kit for playing a golf-like game 10, it is apparent that standard commercially available golf clubs are required.

In FIG. 1, a new and improved kit for playing a golf-like game 10 of the present invention for providing golfers with a fun and challenging alternative to conventional golf is illustrated and will be described. More particularly, the kit for playing a golf-like game 10 has a mat 12, a tube 14 with its opposing ends inserted into the opposing ends of a T-joint 16 to comprise a ring 18, a pole 22 with one end inserted into the middle of the T-joint 16 and its opposing end attached to a flag 24, and a golf ball. In the current embodiment, mat 12 is made of artificial turf, tube 14 is flexible polyvinyl tubing with a length of 48 in., a ½ inch outer diameter, and a ⅜ inch inner diameter, pole 22 is 18 in. long, ¼ inch in diameter, and made of wood, and flag 24 is 9 in. by 6 in. and made of vinyl. Golf ball 20 is made of plastic in the current embodiment.

Moving on to FIG. 2, a new and improved kit for playing a golf-like game 10 of the present invention for providing golfers with a fun and challenging alternative to conventional golf is illustrated and will be described. More particularly, the kit for playing a golf-like game 10 has a mat 12, tube 14, T-joint 16, golf balls 20, pole 22, flags 24, and marker 26. In the current embodiment, three T-joints 16, three tubes 14, three poles 22, three flags 24, and six golf balls 20 are included as part of the kit for playing a golf-like game 10. In the current embodiment, the flags 24 are each a different color, one being red, one being yellow, and one being blue. The marker 26 is used to write the player's name (not shown) on one or more of the golf balls 20 to show ownership.

Concluding with FIG. 3, a new and improved kit and method for playing a golf-like game 10 of the present invention for providing golfers with a fun and challenging alternative to conventional golf is illustrated and will be described. More particularly, the kit and method for playing a golf-like game 10 has a set of three rings 18 formed by the tubes 14 and T-joints 16. Each of the rings 18 has a flag 24 connected to it by a pole 22. In one method of play, the rings 18 are arranged so that the ring 18 with the red flag 24 is closest to the mat 12, the ring 18 with the blue flag 24 is furthest from the mat 12, and the ring 18 with the yellow flag 24 is an intermediate distance from the mat 12. Each player (not shown) places their golf ball 20 on mat 12 and strikes their golf ball 20 with a golf club (not shown) with the objective of landing within one of the rings 18. The player accrues 200 points for landing in the ring 18 with the blue flag 24, 100 points for landing in the ring 18 with the yellow flag 24, 50 points for landing in the ring 18 with the red flag 24, and no points for landing outside of the rings 18. The first player to reach a total of 500 points in the fewest number of shots wins.

In use, it can now be understood that the users determine the desired method of play. For the horseshoes variety of play, the players arrange two rings 18 approximately 25 ft. apart and try to shoot their golf ball 20 into the opposing player's ring 18. Three points are accrued if the player's golf ball has landed in the opposing player's ring, two points are accrued if the player's golf ball is abutting the outside of the opposing player's ring, one point accrues if the player's golf ball is within a club length of the opposing player's ring, and no points accrue if the player's golf ball is beyond a club length of the opposing player's ring. For the traditional golf variety of play, the players arrange one or more rings 18 to simulate one or more golf holes. The players tee off from the mat 12 and try to reach the ring 18 with as few strokes as possible. Upon reaching all the rings, the players' scores are totaled, and the lowest overall score wins. For the "Golf 500" variety of play, the players follow the method described in the discussion of FIG. 3.

While a current embodiment of the kit and method for playing a golf-like game has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the polyvinyl tube described. Also, the wooden pole may also be made of plastic, steel, aluminum, titanium, or carbon fiber composite. Furthermore, a wide variety of rules and ring arrangements may be used instead of the methods described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for playing a golf-like game having at least one golf ball, at least one tube having opposing ends, at least one T-joint having opposing ends and a middle, at least one pole having opposing ends, and at least one flag with said tube having its opposing ends connected to said opposing ends of said T-joint to form a ring, said pole having one end connected to said middle of said T-joint and its opposing end connected to said flag, at least one mat, and at least one marker, comprising the steps of:

a. placing two rings in an area;

b. identifying one or more players to play the game;

c. writing each player's name on at least one golf ball using the marker;

d. assigning one of the rings to each player;

e. standing adjacent to their assigned ring, each player taking turns placing his or her golf ball adjacent to their assigned ring and striking it with a golf club towards the opposing player's ring;

f. determining the score of each player by adding three points if the player's golf ball has landed in the opposing player's ring, two points if the player's golf ball is abutting the outside of the opposing player's ring, one point if the player's golf ball is within a club length of the opposing player's ring, and no points if the player's golf ball is beyond a club length of the opposing player's ring; and g. repeating steps (e) and (f) until a player achieves a total score of 21 or more points, thereby establishing a winner.

2. The method for playing a golf-like game as defined in claim 1, wherein step (a) further comprises the rings being placed about 25 ft. apart.

3. The method for playing a golf-like game as defined in claim 1, wherein the players play in teams of two.

4. The kit for playing a golf-like game as defined in claim 1, wherein said tube is about 48 in. long.

5. The kit for playing a golf-like game as defined in claim 1, wherein said pole is about 18 in. long.

* * * * *